US012582887B2

(12) United States Patent
Lahnan et al.

(10) Patent No.: US 12,582,887 B2
(45) Date of Patent: Mar. 24, 2026

(54) SWING EXERCISE MACHINE

(71) Applicants: Lawrence M Lahnan, Aurora, OH (US); L Christopher Verna, Boca Raton, FL (US)

(72) Inventors: Lawrence M Lahnan, Aurora, OH (US); L Christopher Verna, Boca Raton, FL (US)

(73) Assignee: Shock Force Trainer, LLC, Boca Raton, FL (US)

( * ) Notice: Subject to any disclaimer, the term of this patent is extended or adjusted under 35 U.S.C. 154(b) by 140 days.

(21) Appl. No.: 18/132,405

(22) Filed: Apr. 9, 2023

(65) Prior Publication Data

US 2024/0335723 A1 Oct. 10, 2024

(51) Int. Cl.

| | |
|---|---|
| ***A63B 69/36*** | (2006.01) |
| ***A63B 21/00*** | (2006.01) |
| ***A63B 21/04*** | (2006.01) |

(52) U.S. Cl.

CPC .... *A63B 69/3623* (2013.01); *A63B 21/00069* (2013.01); *A63B 21/0442* (2013.01); *A63B 21/4045* (2015.10)

(58) Field of Classification Search

CPC ..... A63B 69/3623; A63B 21/00069; A63B 21/0442; A63B 21/4045; A63B 21/4035; A63B 21/4047; A63B 2225/09; A63B 2225/093

USPC ..... 473/218, 220, 224, 229, 257–263, 271, 473/273

See application file for complete search history.

(56) References Cited

U.S. PATENT DOCUMENTS

| | | | | |
|---|---|---|---|---|
| 5,082,262 | A * | 1/1992 | Sanchez | A63B 69/0002 473/458 |
| 7,841,971 | B2 * | 11/2010 | Smith | A63B 21/154 482/103 |
| 8,956,237 | B2 * | 2/2015 | Campitelli | A63B 69/3621 473/220 |
| 2005/0113217 | A1 * | 5/2005 | Kuo | A63B 21/0628 482/99 |
| 2012/0004081 | A1 * | 1/2012 | Ellis | A63B 21/4047 482/97 |
| 2014/0121071 | A1 * | 5/2014 | Strom | A63B 21/156 482/99 |
| 2017/0266481 | A1 * | 9/2017 | Dalebout | A63B 21/0552 |

* cited by examiner

*Primary Examiner* — Nini F Legesse

(74) *Attorney, Agent, or Firm* — The Law Offices of Louis M. Heidelberger Esq.

(57) ABSTRACT

An exercise machine for developing the speed of the swing of an item of sports equipment in which the resistance to movement of the sports equipment is separate from the control of the path of movement of the item of sports equipment and is continuously as contrasted with step-wise variable. The resistance may be adjusted with one hand independently of the position or movement of the item, and specialized skill or training in not required. The machine may be used for both left-handed and right-handed users without material adjustment.

8 Claims, 5 Drawing Sheets

SWING EXERCISE MACHINE

BACKGROUND OF THE INVENTION

The present invention relates to an improved swing exercise machine and more particularly to an exercise machine for improving swing speed, e.g., the swing speed of sports equipment such as a golf club or baseball bat. More particularly, the present invention relates to an improved resistance unit for a swing exercise machine.

Training devices are well known in the prior art for teaching a person how to properly swing a golf club, a baseball bat, a tennis racket, etc., i.e., the proper swing path of the sports equipment being used. The present invention is not a swing teaching device, but is an exercise machine for users who already have the ability to execute the swing path and are interested in developing a higher swing speed as a way of achieving greater distance for a ball when struck by the selected sports equipment such as a golf club or a baseball bat.

Many exercise machines employ resistance units and thus may also be used to develop an increase in the swing speed of the sports equipment. Generally, swing trainers with resistance elements consist of a base on which the user stands facing an upright structure or frame. A swing arm is pivotably mounted on the frame and a cable is suspended from the free end thereof. Sports equipment such a golf club, baseball bat, tennis racket, hockey stick or the like is attached to the free end of the cable and suspended in position to be grasped by the user as he stands facing the frame. The cable generally runs from the selected sports equipment through a pulley system mounted on the swing arm and the frame, and the distal end thereof is functionally attached to the frame. The resistance unit is often included in the cable in the form of a coiled spring and user must stretch the spring to move the swing arm. Incremental adjustment of the resistance in such units is often provided by varying the point of attachment of the spring to the frame or by suspending weight plates therefrom.

In operation, the user stands facing the frame and grasps the sports equipment. Swinging the sports equipment rotates the swing arm against the resistance of the spring to provide the desired exercise.

Such prior art swing exercise machines have taken a variety of forms. For example, the Hundley U.S. Pat. No. 5,242,344 dated Sep. 7, 1993 and the Smith U.S. Pat. No. 7,841,971 dated Nov. 30, 2010 provide for incremental resistance to rotation of the swing arm by weighted plates. The Fitch U.S. Pat. No. 5,050,874 dated Sep. 24, 1991 and the McFarlin U.S. Pat. No. 7,585,228 dated Sep. 8, 2009 provide resistance to swing arm movement through a friction unit at the connection between the frame and the spring arm.

Other prior art swing exercise machines such as the Hart U.S. Pat. No. 5,156,402 dated Oct. 20, 1992 eliminate the cable system in its entirety and provide resistance to the swing of a baseball bat attached to the swing arm by means of a coiled spring and a camming mechanism between the swing arm and the frame. This resistance may be incrementally varied by varying the point of attachment of the coiled spring to camming mechanism.

Still other prior art swing exercise machines such as the Campitelli U.S. Pat. No. 8,955,237 dated Feb. 7, 2015 retain a cable system for controlling the swing arm in response to movement of the sports equipment, but substitute a resistance unit between the swing arm and the frame for the resistance unit in the cable system.

The resistance to movement of the swing arm in the Capitelli swing trainer is provided by a conventional shock absorber the resistance of which may be incrementally variable by changing the points of connection of the shock absorber to the swing arm and the frame, i.e., the amount of extension of the shock absorber required to execute the desired movement of the swing arm.

Prior art swing exercise systems such a Capitelli have a number of practical disadvantages. They are generally dedicated to a particular sport such a golf where the limitations imposed by the teaching of the golf swing impose limitations on the use of the machine to develop swing speed. The user stands facing the frame to grip the exercise equipment and, to be suitable for both right-handed and left-handed golfers, the exercise machine must have bilateral symmetry, i.e., the swing arm must be centered relative to the frame and the shock absorber resistance unit must be moved from one side to the other of the swing arm to provide the desired resistance to movement of the swing arm in a particular direction.

In addition, the amount of resistance provided by shock absorbers has in prior machines been adjusted by movement of the point of contact of the shock absorber to the frame. Capitelli for example, utilizes a long curved bar laterally extending on both sides of the swing arm with a number of discrete positions on both sides to which the shock absorber may be attached, thus providing stepwise adjustment on the resistance provided by the shock absorber.

Such stepwise adjustment is awkward in that the swing arm has to be positioned for the user, and held in that position while the adjustment in the point of attachment of the shock absorber to the frame is made. This requires two hands and some experience with the machine and, because the swing arm swings freely without the attachment of the resistance unit, presents safety issues unless two people are participating.

After all these years in the development of a swing speed exercise machine, the need remains for a machine which can be used by both right-handed and left-handed users without material adjustment, and in which the amount of resistance can be quickly and easily, and safely, adjusted by the user with one hand during an exercise session. It is accordingly an object of the present invention to obviate many of the problems of the known prior art and to provide a novel swing speed exercise machine and a novel resistance unit.

Exercise machines are often open to the public, or at least to some segment of the public such as gym members or country clubs, and professional staff is not always available to explain or monitor the proper use of the machine. Another object of the present invention is to provide an exercise machine which does not require complicated instructions in advance of use, and is easy to use and to adjust.

Known prior art exercise machines are often difficult to adjust for right-hand or left-hand use. Most, if not all, swing exercise machines require that the user perform both right-hand and left-hand swings facing the machine, and the swing arm be moved from one side of the platform to the other to switch the direction of swing. Still another object of the present invention is to provide a swing speed exercise machine which can be used by both right-handed and left-handed users without any change in the set up of the machine, and which can used either facing the machine or with the user's back to the machine.

A further object of the present invention is to provide a novel swing speed exercise machine in which the exercise resistance in easily and continuously varied by the user in an exercise session by one hand without any change in the set up of the machine.

These and many other objects and advantages will be readily apparent to one skilled in the art to which the invention pertains from a perusal of the claims, the appended drawings, and the following detailed description of the preferred embodiments.

BRIEF DESCRIPTION OF THE DRAWINGS

FIG. 5 C is pictorial view of the tension adjuster from the top.

DETAILED DESCRIPTION OF PREFERRED EMBODIMENTS

Figure 1:
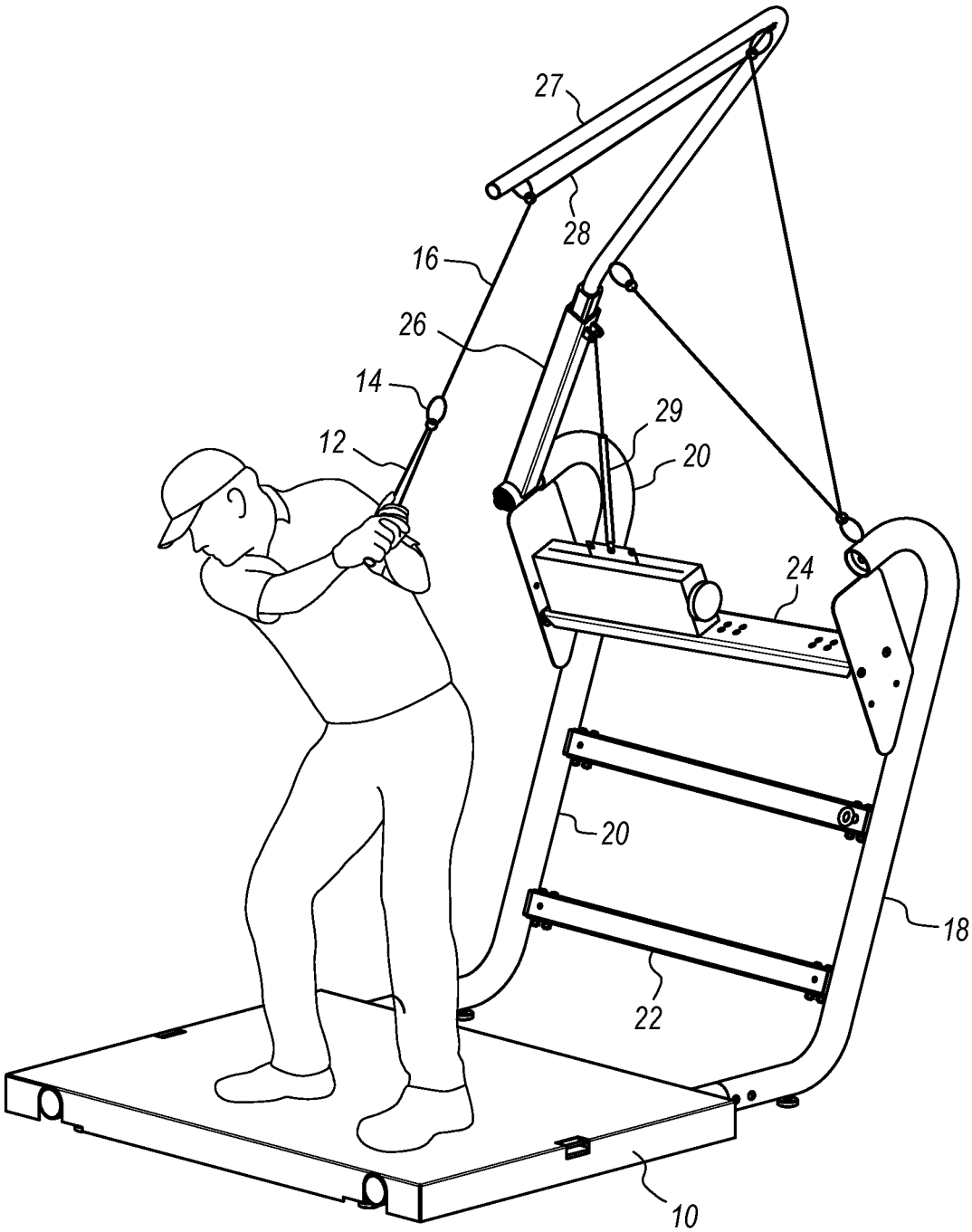
FIG. 1 is a pictorial view of the exercise machine of the present invention in use by a left-handed golfer.
Figure 2:
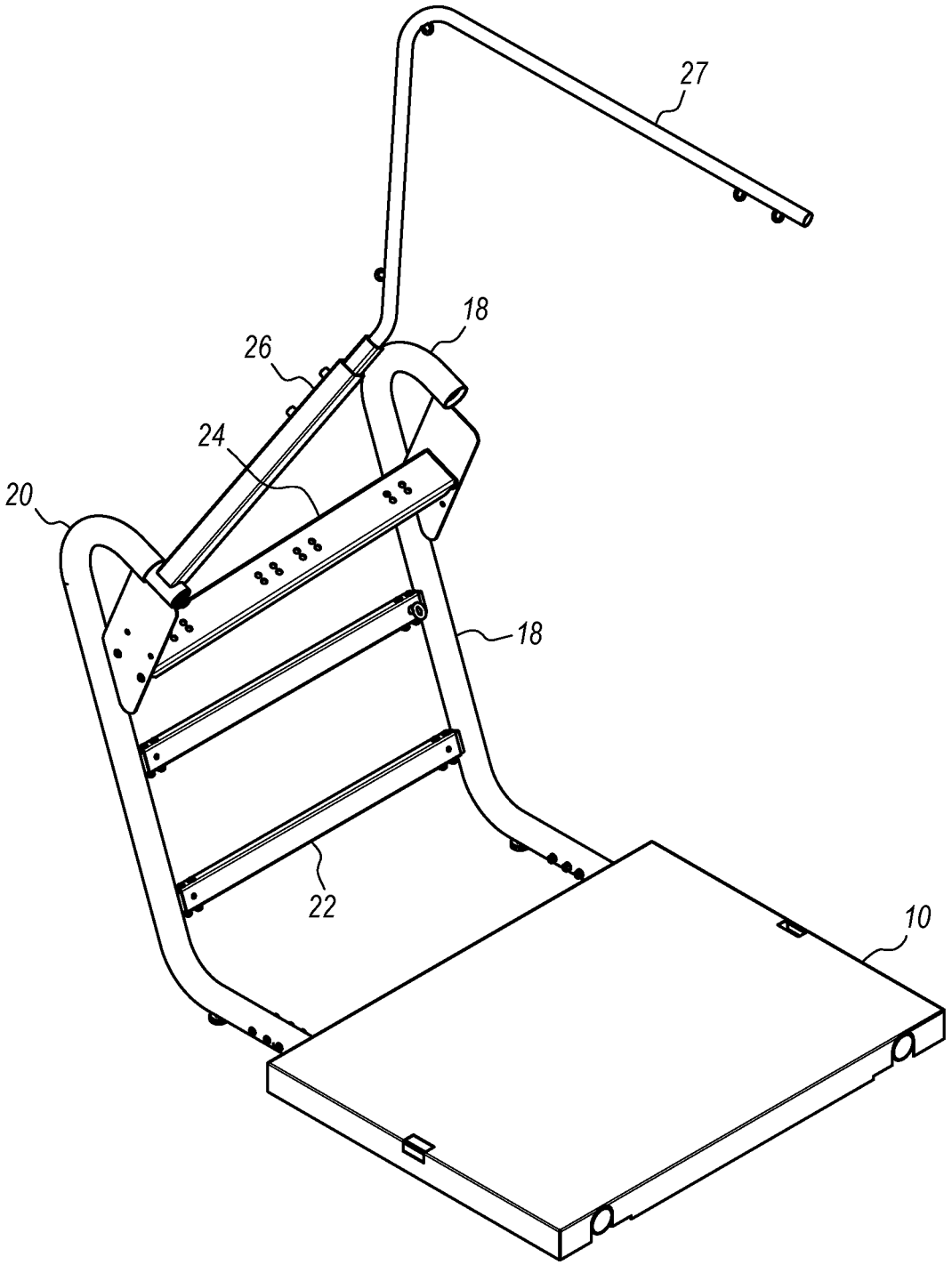
FIG. 2 is a perspective view of the exercise machine platform and swing arm.
Figure 3:
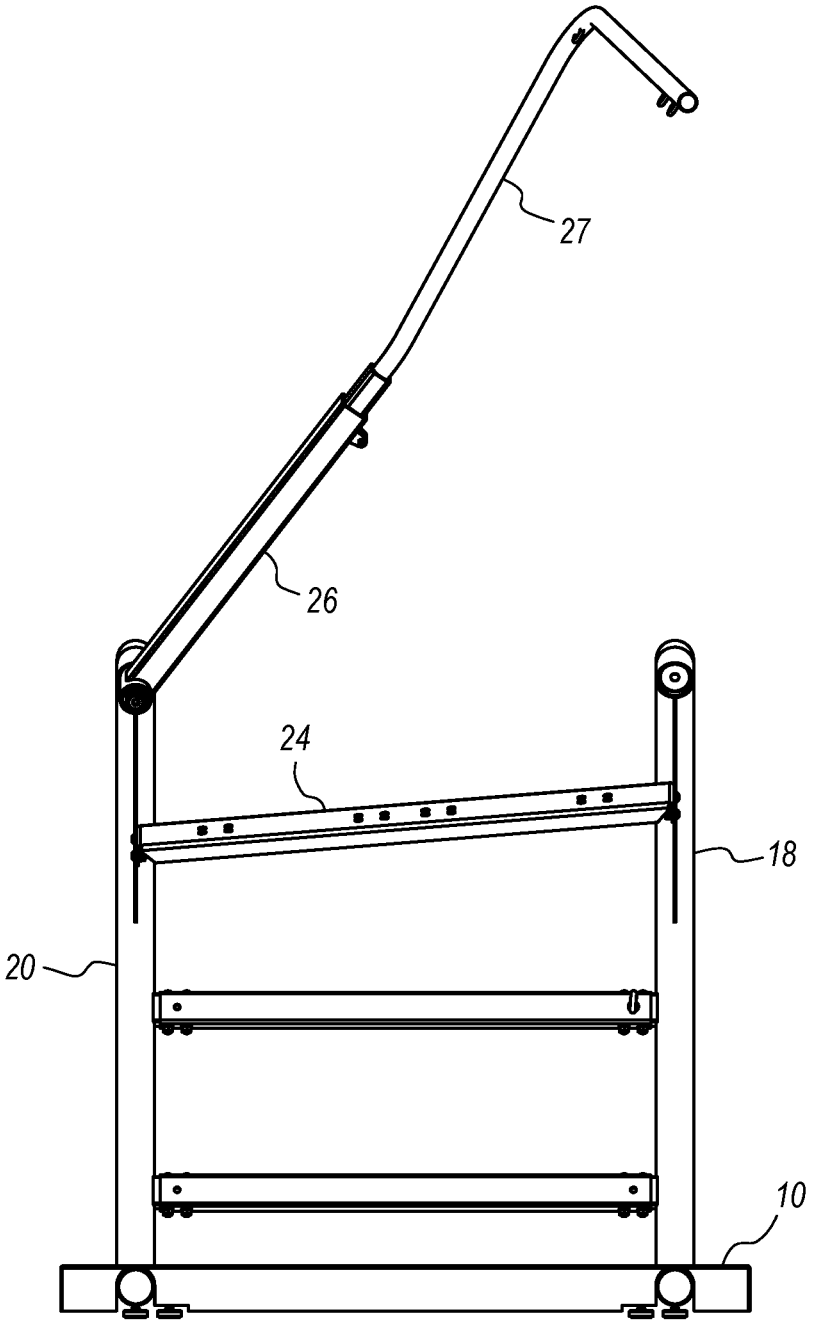
FIG. 3 is a view in elevation of the stand and swing arm from the left side.
Figure 4:
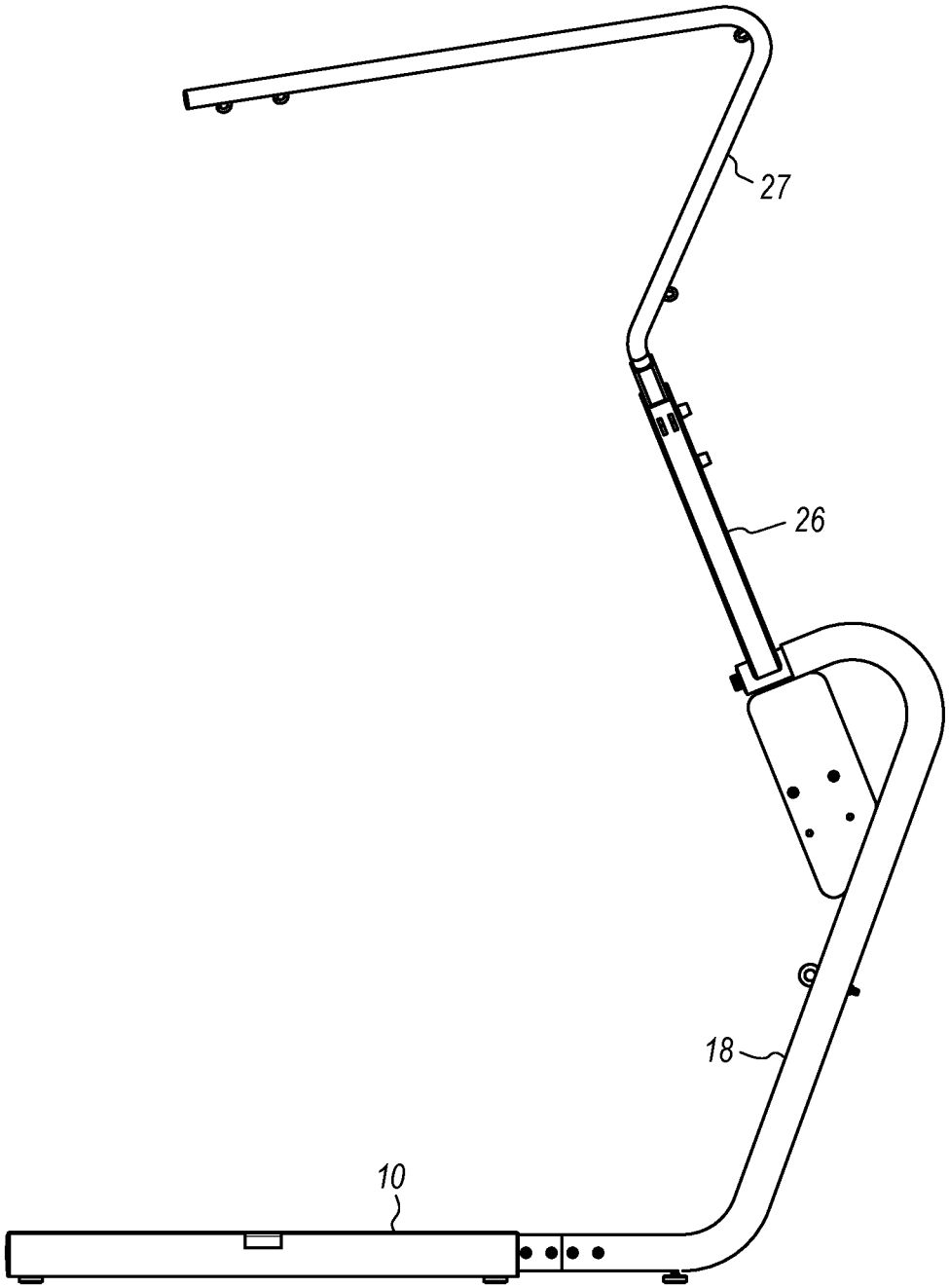
FIG. 4 is view in elevation of the stand and swing arm from the right side.

With reference now to the figures disclosing embodiments of the present invention where like numerals are used to indicate like elements throughout, one embodiment is pictorially illustrated in FIG. 1 where a user is depicted standing on a stand or platfom 10 grasping a handle 12. The handle 12 is connected through a universal fitting 14 to a cable 16.

With continued reference to FIGS. 1-4, the platform 10 is rigidly connected to two spaced uprights 18, 20. The uprights 18, 20 are connected by two cross bars 22, 24 and are themselves shaped and braced to provide a stable support for a rotatable swing arm receiver 26.

A swing arm 27 is rigidly received by the receiver 26 which extends outwardly over the platform 10 and mechanically supports a pulley system or a cable 28 that runs from the fitting 13 of the handle 12 along the swing arm 27 and downwardly to the lower cross bar 22 and then upwardly back to the lower end o the swing arm 27.

In use as illustrated, the downward swinging movement of the handle 12 by the user causes the swing arm 27 and swing arm receiver 26 to rotate about the pivotable connection of the swing arm receiver 26 to the upright 20.

Resistance to this rotation by the swing arm 27 is provided by a resistance unit 30 connected between the swing arm 27 and a tension adjuster 32 mounted on the upper cross arm 24.

The size and configuration of the platform 10 and the swing arm 27 is desirably such that the user may stand with his back to the uprights 18, 20 and swing left-handed, or alternatively stand facing the uprights 18, 20 in position for a right-handed swing.

The generally preferred swing, at least in golf, is forward and slightly downward. Because most golfers are right-handed, and because users may favor exercise facing the machine, the upper cross-arm 24 between the uprights 18,20 may be slanted downwardly to the left between about 2 and about seven degrees preferably about 5 degrees.

The resistance unit 29 of FIG. 1 may conveniently comprise a conventional nitrogen gas shock absorber connected to the swing arm 27 at the closed end with the variably extension rod end connected to the tension adjuster 32.

The function of the tension adjuster 32 is to vary the point of connection of the resistance unit to the upper cross bar 24, thereby varying the amount of extension (i.e., the compression) of the shock absorber of the resistance unit 30 required for a given rotation of the swing arm 27 in response to movement of the handle 12.

Figure 5A:
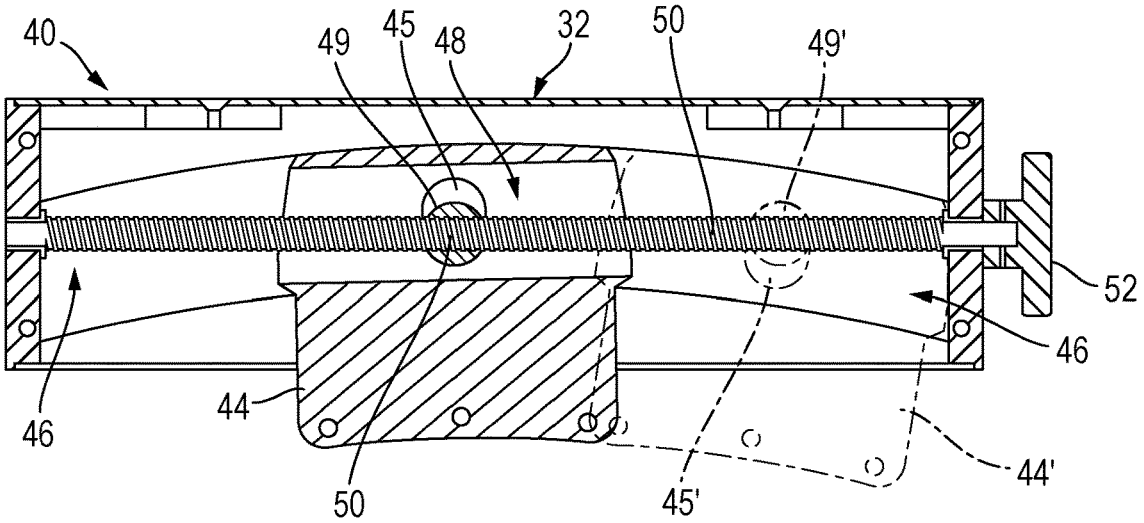
FIG. 5A is a longitudinal section of the tension adjuster.
Figure 5B:
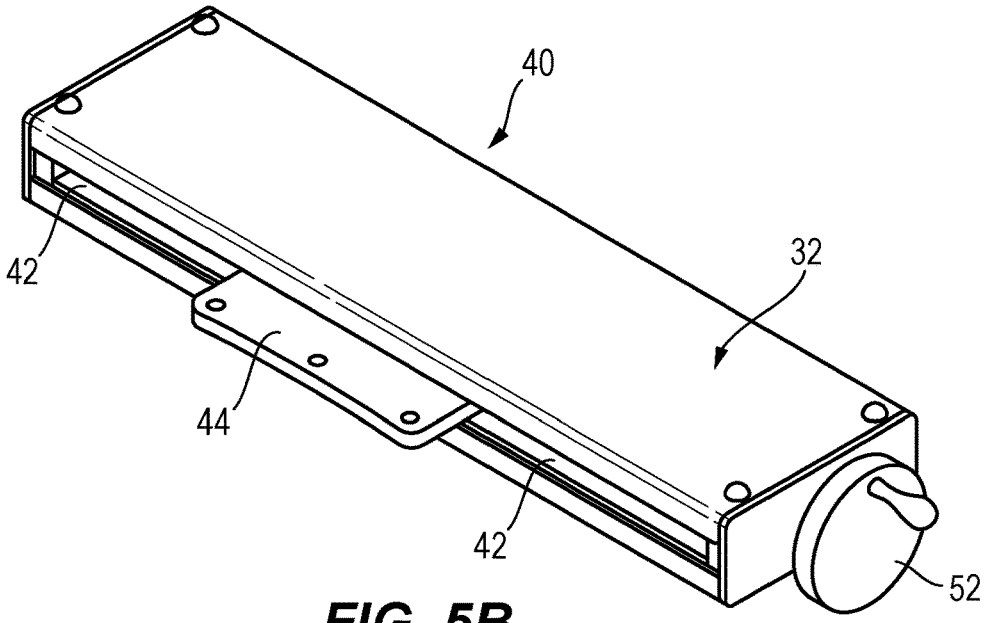
FIG. 5 B is a pictorial view of the tension adjuster.
Figure 5C:
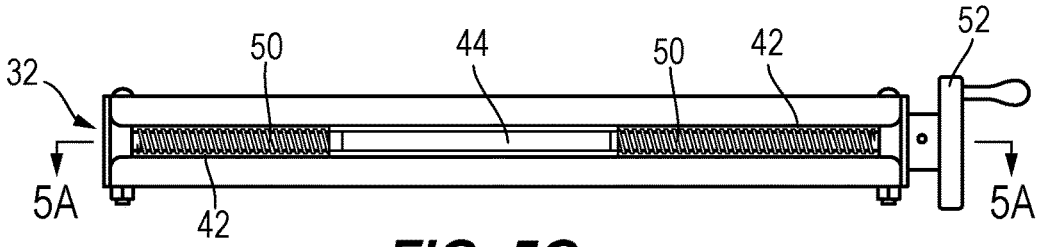

One embodiment of the tension adjuster 32 is illustrated in FIG. 5. With reference to FIGS. 5A, 5B and 5C, the tension adjuster 32 includes a housing 40 having a longitudinal slit 42 in the upper surface through which a connector 44 extends to provide for mechanical attachment to the internal parts of the tension adjuster 32.

Internally of the housing 40 and running the length thereof is curved sleeve 46 configured to slidingly receive a travel block 48. The travel block 48 is threadably connected through a floating nut 49 to a bolt 50 which runs the length of the housing 40 and extends through the end of the housing 40. A manual adjustment wheel 52 is attached to the bolt 50 externally of the housing 40.

In use, the user simply turns the wheel 52 to rotate the bolt 50. Rotation of the threaded rod 50 moves the floating nut 49 axially along the rod 50. The movement of the floating nut 49 moves the travel block 48 axially along the bolt 50 and with it the connector 44. Movement of the connector 44 along the bolt 50 results in side-to-side movement of the point of connection of the resistance unit 29 to the uprights 18,20 and platform 10, and thus adjusts the tension provided by the tension unit 29.

To switch the direction of swing, the user may simply turn around, and a right-handed user may follow a left-handed user, or vice versa, without any change in the set up of the machine.

Advantages and Scope of Invention

Many advantages will occur to one skilled in this art from the above description of preferred embodiments. Among these advantages is the ability of the user to adjust the tension provided with one hand by tuning the wheel 52. Note that the swing arm 27 does not have to be in any particular position relative the platform 10 at the time of the adjustment, and does not have to be stationary. This means that the tension provided by the resistance 29 may continue while the adjustment is being made.

Moreover, the tension provided by the resistance unit 29 is infinitely variable (through the use of a screw thread) rather than in the discrete increments required by prior art resistance adjustments.

Importantly, no change in the set-up of the machine is required for right-hand or left-hand use, and the use of the machine is intuitive so that a professional staff is not required to explain the operation and to assist in the set-up.

While preferred embodiments of the present invention have been described, it is to be understood that the embodiments described are illustrative only and many variations and modifications will naturally occur to those of skill in this art from a perusal hereof. Accordingly, the scope of the invention is to be defined solely by the appended claims when accorded a full range of equivalence.

What is claimed is:

1. An exercise machine comprising:

a platform on which the person performing the exercise stands, said platform integral with at least one support upright;

a generally horizonal bar supported at one end of said support upright of said platform;

an elongated exercise arm, one end of said exercise arm being pivotably supported by said generally horizontal bar and the other end having a grip for movement by the person performing the exercise;

a variable resistance unit having a variably extending actuator for selectively varying the resistance to movement of said exercise arm by the person performing the exercise; said resistance unit including a resistance element having (a) a closed end and (b) an end having a longitudinally extending shaft providing variable resistance to movement of the resistance unit;

a resistance adjusting unit having an elongated body and a travel block that moves within a longitudinal portion of said elongated body with a portion thereof internal to said elongate body and a potion thereof external to said elongated body, the distal end of said resistance unit being pivotably connected to said travel block external of said elongated body; said travel block adjusted by the person performing the exercise, said resistance adjusting unit including (a) a threated rod, (b) a nut that engages the threaded rod and the travel block via an elongate opening in the travel block that operates together with the threaded rod to move the travel block axially as the threaded rod turns, a curved sleeve surface internal of the elongated body along which said travel block travels in response to the rotation of said threaded rod, and (c) a manually rotatable adjustment wheel external of said body by which said threaded rod may be manually rotated, the manual rotation of said adjustment wheel varying the position of said travel block along said curved sleeve and thus said point of connection of said resistance unit to said elongated body, said elongate opening of said travel block allowing the nut to float vertically within the oblong opening when the travel block moves axially and follows the curved sleeve and said point of connection of said resistance unit varying the resistance of said resistance unit to movement of said exercise arm by the person performing the exercise.

2. The exercise machine of claim 1 wherein the extension of said platform from said generally horizontal bar and the extension of said exercise arm from said bar are such that the person performing the exercise while performing the exercise may selectively stand on said platform (a) facing said generally horizontal bar portion of the support upright or (b) stand on said platform with his back to said generally horizontal bar of the support upright.

3. The exercise machine of claim 1 including (a) a grip and (b) a pulley system connected at one end to said handle and at the other end to said exercise arm, wherein movement of said exercise arm is accomplished by movement of said grip by the person performing the exercise.

4. The exercise machine of claim 1 wherein the resistance of said resistance adjusting unit may be manually adjusted without removing pressure from said variable resistance unit.

5. The exercise machine of claim 1 wherein the resistance of said resistance adjusting unit is manually adjusted with one hand by rotation of said adjustment wheel.

6. The exercise machine of claim 1 wherein the curved sleeve of said resistance adjusting unit is downwardly concave.

7. The exercise machine of claim 1 wherein said resisting adjustment unit slopes laterally between 1 and 7 degrees to the horizontal.

8. The exercise machine of claim 7 wherein said resisting adjustment unit slopes laterally approximately 5 degrees to the horizontal.

* * * * *